US007673643B2

(12) United States Patent
Seo

(10) Patent No.: US 7,673,643 B2
(45) Date of Patent: Mar. 9, 2010

(54) COLLAPSIBLE CANOPY HAVING WHEELS

(75) Inventor: Dong Woog Seo, Taegu (KR)

(73) Assignee: Caravan Canopy International, Inc., La Mirada, CA (US)

( * ) Notice: Subject to any disclaimer, the term of this patent is extended or adjusted under 35 U.S.C. 154(b) by 0 days.

(21) Appl. No.: 12/100,920

(22) Filed: Apr. 10, 2008

(65) Prior Publication Data

US 2008/0190474 A1 Aug. 14, 2008

Related U.S. Application Data

(63) Continuation of application No. 10/759,491, filed on Jan. 15, 2004, now Pat. No. 7,380,563.

(30) Foreign Application Priority Data

Jan. 17, 2003 (KR) ..... 2003-0001545

(51) Int. Cl.
*E04H 15/46* (2006.01)

(52) U.S. Cl. ..... 135/139; 135/120.1; 135/912

(58) Field of Classification Search ..... 135/114, 135/120.1, 131, 96, 912; 16/30, 43, 42 T; 248/129, 346.11; 280/47.131, 47.18, 47.31, 280/47.24, 47.27
See application file for complete search history.

(56) References Cited

U.S. PATENT DOCUMENTS 1,383,773 A * 7/1921 Smithfield ..... 16/18 R
1,912,795 A 6/1933 Rice et al.
3,018,506 A 1/1962 Haydock
3,487,495 A 1/1970 Schultz, Jr.
3,655,077 A 4/1972 Lowe
3,656,293 A * 4/1972 Lowery, Sr. ..... 59/86
4,068,342 A 1/1978 Carrier
4,129,921 A 12/1978 Greene
4,361,930 A 12/1982 Seesengood
4,918,783 A * 4/1990 Chu ..... 16/19
4,969,230 A * 11/1990 Huang ..... 16/30
5,062,178 A 11/1991 Chiu
5,263,507 A 11/1993 Chuang
5,390,394 A 2/1995 Huang
5,444,946 A 8/1995 Zeigler
5,797,411 A 8/1998 Parker
5,839,462 A 11/1998 Randall
5,924,832 A * 7/1999 Rice ..... 414/23
6,361,057 B1 3/2002 Carter
6,550,491 B1 4/2003 Bixler et al.
2002/0074032 A1 6/2002 Parker et al.

* cited by examiner

*Primary Examiner*—David Dunn
*Assistant Examiner*—Noah Chandler Hawk
(74) *Attorney, Agent, or Firm*—Christie, Parker & Hale, LLP.

(57) ABSTRACT

A collapsible canopy frame is provided that includes elongated side poles each having a side and an end; and a plurality of wheel assemblies each having a mounting post and a wheel. The mounting post of each wheel assembly is supported on and extends transverse to a corresponding one of the elongated side poles.

29 Claims, 10 Drawing Sheets

COLLAPSIBLE CANOPY HAVING WHEELS

CROSS-REFERENCE TO RELATED APPLICATION(S)

This application is a continuation of U.S. patent application Ser. No. 10/759,491 filed Jan. 15, 2004, issued as U.S. Pat. No. 7,380,563, which claims priority to and the benefit of Korean Utility Model Application No. 2003-0001545 filed on Jan. 17, 2003 in the Korean Intellectual Property Office, now registered as Utility Model Registration No. 0312124 on Apr. 21, 2003, the entire contents of both of which are incorporated herein by reference.

FIELD OF THE INVENTION

The present invention relates to a collapsible canopy frame, and more particularly to a collapsible canopy frame having a wheel assembly removably attached thereto that facilitates transportation of the collapsible canopy frame.

BACKGROUND

Collapsible canopy frames often include a plurality of telescoping legs, each having one or more X-shaped scissor assemblies extending therebetween. A canopy covering, such as a cloth or leather covering, is disposed above, and supported by, the collapsible canopy frame. The X-shaped scissor assemblies are moveable relative to the telescoping legs to adjust the collapsible canopy frame between an expanded position and a collapsed position.

In the expanded position, the collapsible canopy frame provides a temporary shelter. In the collapsed position, the collapsible canopy frame can be more readily transported. Typically, collapsible canopy frames are transported by placing the collapsible canopy frame on a separate wheeled structure, such as a wheeled platform. However, collapsible canopy frames are often relatively heavy and it is therefore desirable to minimize any upward lifting that is required during transportation of a collapsible canopy. Accordingly, a need exists for a wheel assembly and/or components related thereto for attachment to a collapsible canopy frame that facilitates transportation of the collapsible canopy frame.

SUMMARY

In an exemplary embodiment according to the present invention, a collapsible canopy frame is provided that includes elongated side poles each having a side and an end; and a plurality of wheel assemblies each having a mounting post and a wheel. The mounting post of each wheel assembly is supported on and extends transverse to a corresponding one of the elongated side poles.

In another exemplary embodiment of the present application, a collapsible canopy frame is provided that includes elongated side poles each having a side and an end; and a plurality of wheel assemblies each having a mounting post and a wheel. The mounting post of each wheel assembly is supported on and extends transverse to a corresponding one of the elongated side poles. The mounting post of each wheel assembly extends through the side of the corresponding elongated side pole. The collapsible canopy frame also includes a bracket mounted at the end of a corresponding one of each of the elongated side poles. Each bracket and each elongated side pole includes an opening aligned with each other through which the mounting post of the corresponding wheel assembly extends.

In yet another exemplary embodiment of the present invention, a collapsible canopy frame is provided that includes telescoping elongated side poles each having an upper section and a lower section, wherein each lower section includes a side and an end. A set of edge scissor assemblies are pivotably coupled between adjacent ones of the telescoping elongated side poles. Each set of edge scissor assemblies has ribs that rotate relative to each other. The collapsible canopy frame also includes a plurality of wheel assemblies each having a mounting post and a wheel. The mounting post of each wheel assembly is supported on and extends transverse to a corresponding one of the telescoping elongated side poles.

These and other aspects of the invention will be more readily comprehended in view of the discussion herein and accompanying drawings, in which like reference numerals designate like elements.

DETAILED DESCRIPTION

As shown in FIGS. 1-14, the present invention is directed to a collapsible canopy frame having a wheel assembly attached (e.g., removably) thereto that facilitates transportation of the collapsible canopy frame.

Figure 1:
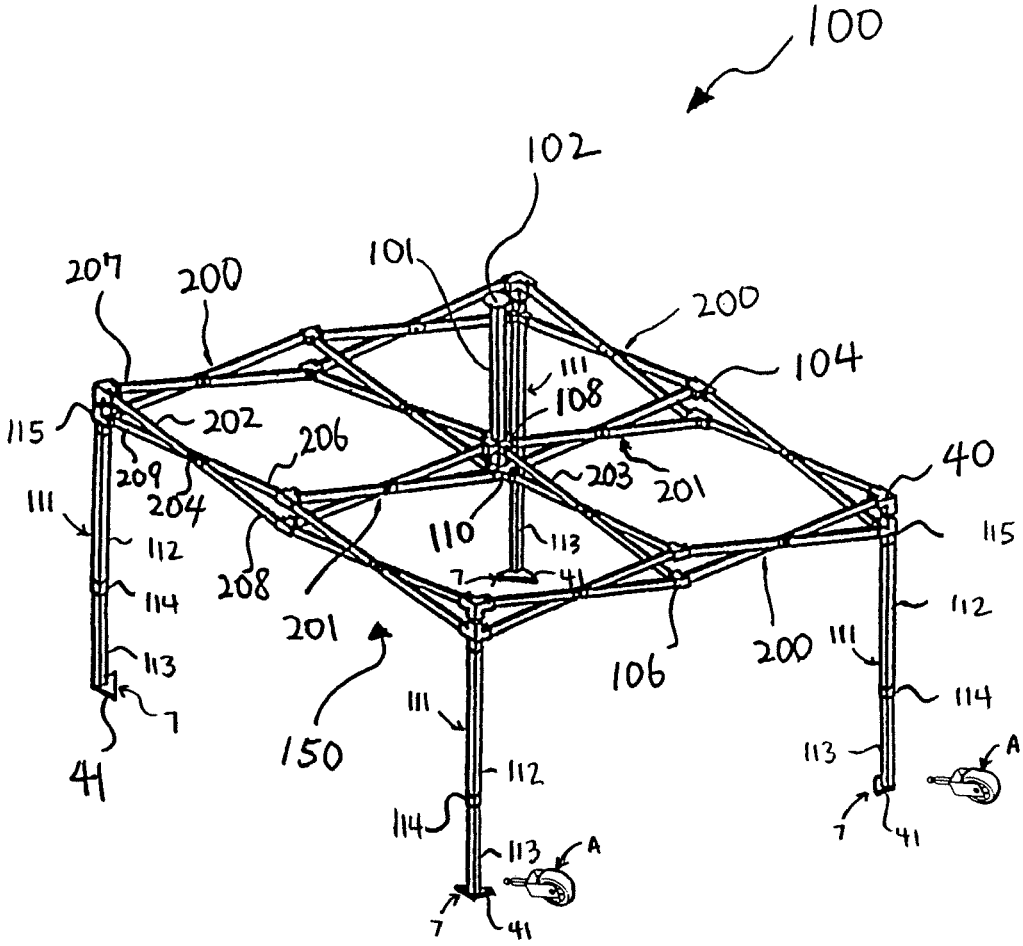
FIG. 1 is a perspective and partially exploded view of a canopy frame in an exemplary embodiment of the present invention.

FIG. 1 illustrates an exemplary embodiment of a collapsible canopy frame according to the present invention having a wheel assembly A. As shown, the collapsible canopy includes a canopy frame 100 having a center support pole 101, four telescoping side poles 111 and edge scissor assemblies 200 that interconnect each pair of adjacent side poles 111. Each of the edge scissor assemblies 200 are formed of a pair of ribs 202 connected together and rotatable about a pivot 204.

In one embodiment, each telescoping side pole 111 has a substantially square cross-section, and foot bracket 7 (described in detail below) having a triangular support plate 41. Each foot bracket 7 is attached at a bottom end of a corresponding one of the side poles 111 for supporting the weight of the collapsible canopy frame 100. Canopy frames in other embodiments may include more than four side poles.

In one embodiment, each pair of adjacent side poles 111 are interconnected to each other through a set 150 of two edge scissor assemblies 200. The set 150 of edge scissor assemblies 200 are pivotably coupled to the respective side poles 111 and to each other. Upper and lower inner ends 206, 208 of each edge scissor assembly 200 are pivotably coupled to the upper and lower inner ends of the other edge scissor assembly 200 of the same set 150 via upper and lower connecting brackets 104 and 106, respectively.

At the top of the center support pole 101 is a convex shaped head member 102, which can support a canopy cover (not shown) at the center of the canopy frame. Also, the center support pole 101 has mounted thereon an upper central hub 108 and a lower central hub 110. The upper central hub 108 is slidable with respect to the center support pole 101 while the lower central hub 110 is substantially stationary with respect to the center support pole 101.

Each telescoping side pole 111 includes two telescoping sections 112 and 113, which correspond to upper and lower sections, respectively. The upper and lower sections 112 and 113 are fixed to each other with a height adjustment bracket 114, which adjusts the relative positions of the upper and lower sections 112 and 113 and therefore the height of each telescoping side pole 111. In other exemplary embodiments, the side poles may not be telescoping, and have a fixed length.

Each telescoping side pole 111 has a stationary bracket 40 and a sliding bracket 115 mounted thereon. At each corner of the canopy frame 100, outer upper ends 207 of the edge scissor assemblies 200 are pivotably coupled to the corresponding stationary bracket 40. In addition, lower outer ends 209 of the edge scissor assemblies 200 are pivotably coupled to the sliding bracket 115.

The canopy frame 100 also includes center scissor assemblies 201. Each of center scissor assemblies 201 is pivotably coupled between the center support pole 101 and a corresponding set 150 of the edge scissor assemblies 201. In more detail, each center scissor assembly 201 is pivotably coupled between the upper and lower connecting brackets 104, 106 of the edge scissor assemblies 200 and the upper and lower central hubs 108, 110 of the center support pole 101. Each center scissor assembly 201 is formed by pivotably coupling a pair of ribs 203 about their respective centers. In one embodiment, the center scissor assembly 201 has substantially the same structure as the edge scissor assembly 200.

Figure 2:
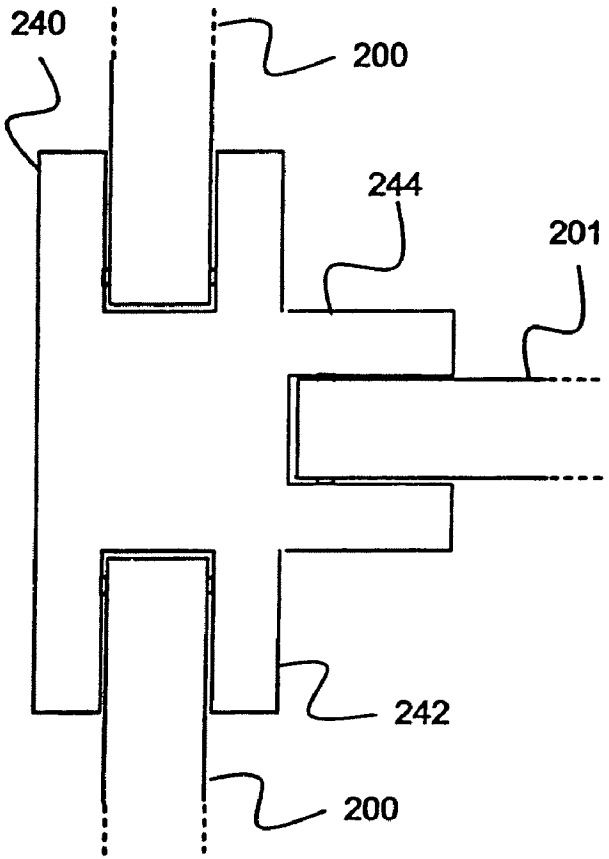
FIG. 2 is a cross-sectional view of a connecting bracket between adjacent edge scissor assemblies.

Referring now to FIGS. 1 and 2, each of the upper and lower connecting brackets 104 and 106 has three connecting members 240, 242 and 244. The connecting members 240 and 242 face at substantially 180 degrees of each other, and are used to pivotably couple the edge scissor assemblies 200 of the same set 150 to each other. The connecting member 244 faces at substantially a right angle with respect to each of the two 180-degree apart connecting members, and is used to pivotably couple the center scissor assembly 201 to the edge scissor assemblies 200.

Figure 3:
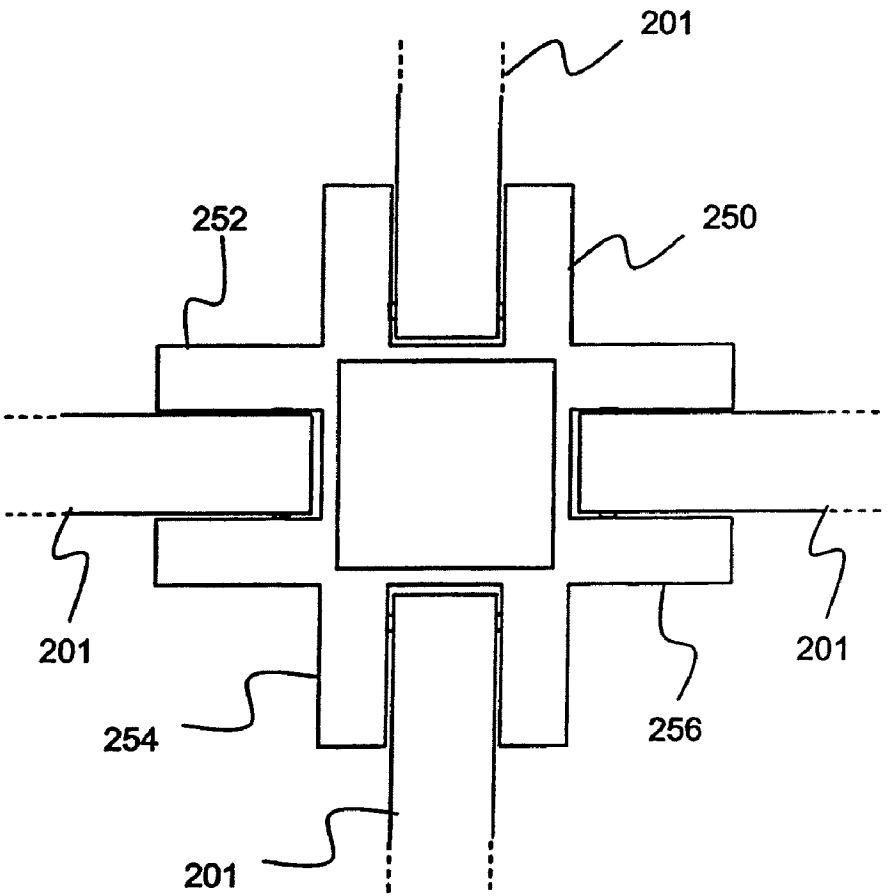
FIG. 3 is a cross-sectional view of a central hub mounted on a center support pole.

Referring now to FIGS. 1 and 3, each of the upper and lower central hubs 108 and 110 has four connecting members 250, 252, 254, 256, each facing one set of edge scissor assemblies. The upper and lower central hubs are pivotably connected to four different center scissor assemblies 201 that extend at approximately 90-degrees apart from one other. Hence, each center scissor assembly 201 is pivotably coupled between the center support pole 101 and the corresponding set 150 of the edge scissor assemblies 200.

Figure 4:
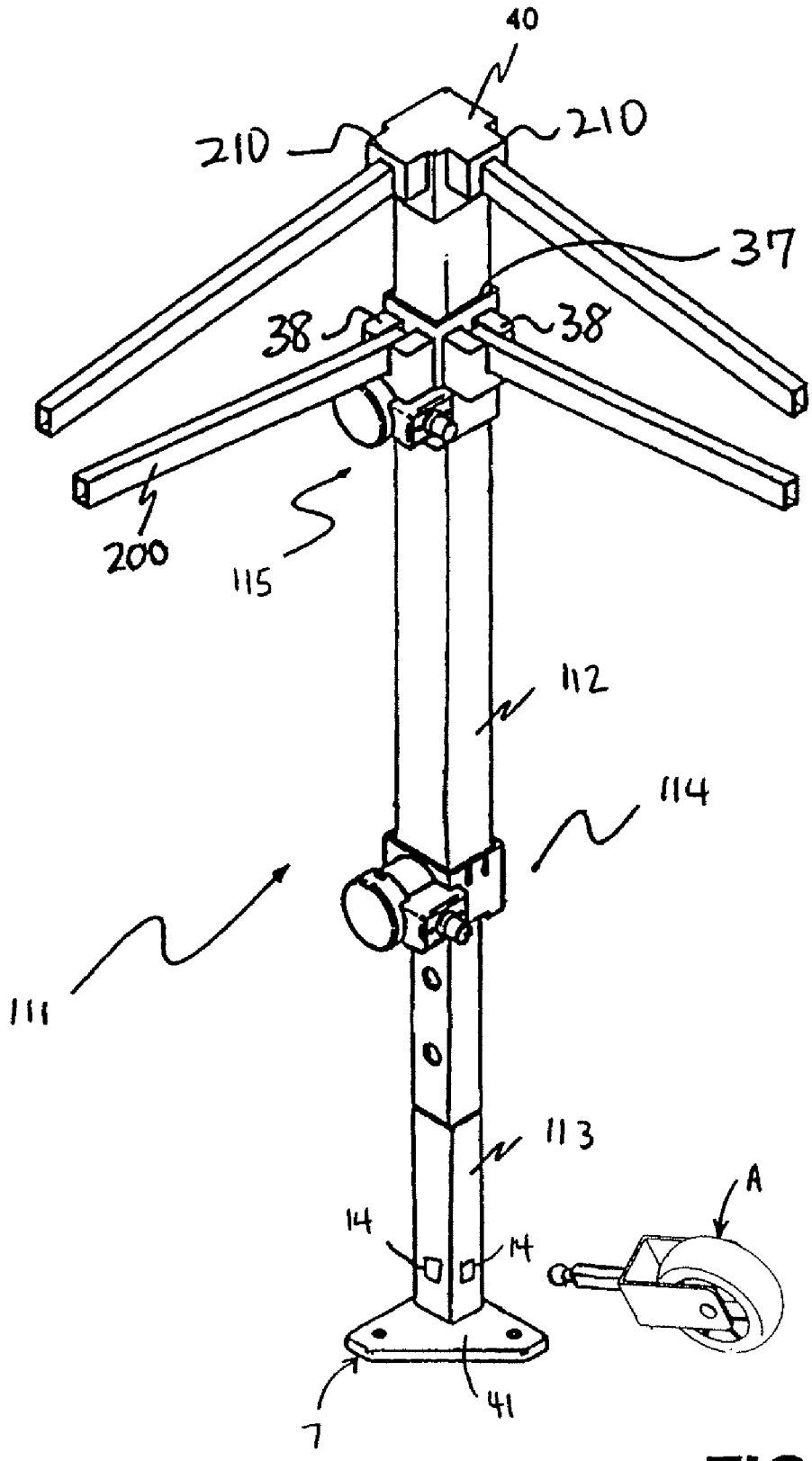
FIG. 4 is a perspective view of a telescoping pole and a detached wheel of the canopy frame of FIG. 1.

FIG. 4 is a detailed view of one of the side poles 111 of the collapsible canopy frame 100. The stationary mounting bracket 40 has two connecting members 210 that face at substantially a right angle to each other for pivotably coupling with the corresponding edge scissor assemblies 200. Similarly, the sliding mounting bracket 115 has two connecting members 38 facing at substantially a right angle to each other for pivotably coupling with the corresponding edge scissor assemblies 200. The sliding mounting bracket 115 has an opening 37 therethrough for slidably coupling with the upper section 112. The opening 37 has a substantially square cross sectional shape to receive in close but slidably fitting relation, the upper section 112, which has a substantially square cross sectional shape.

Figure 14:
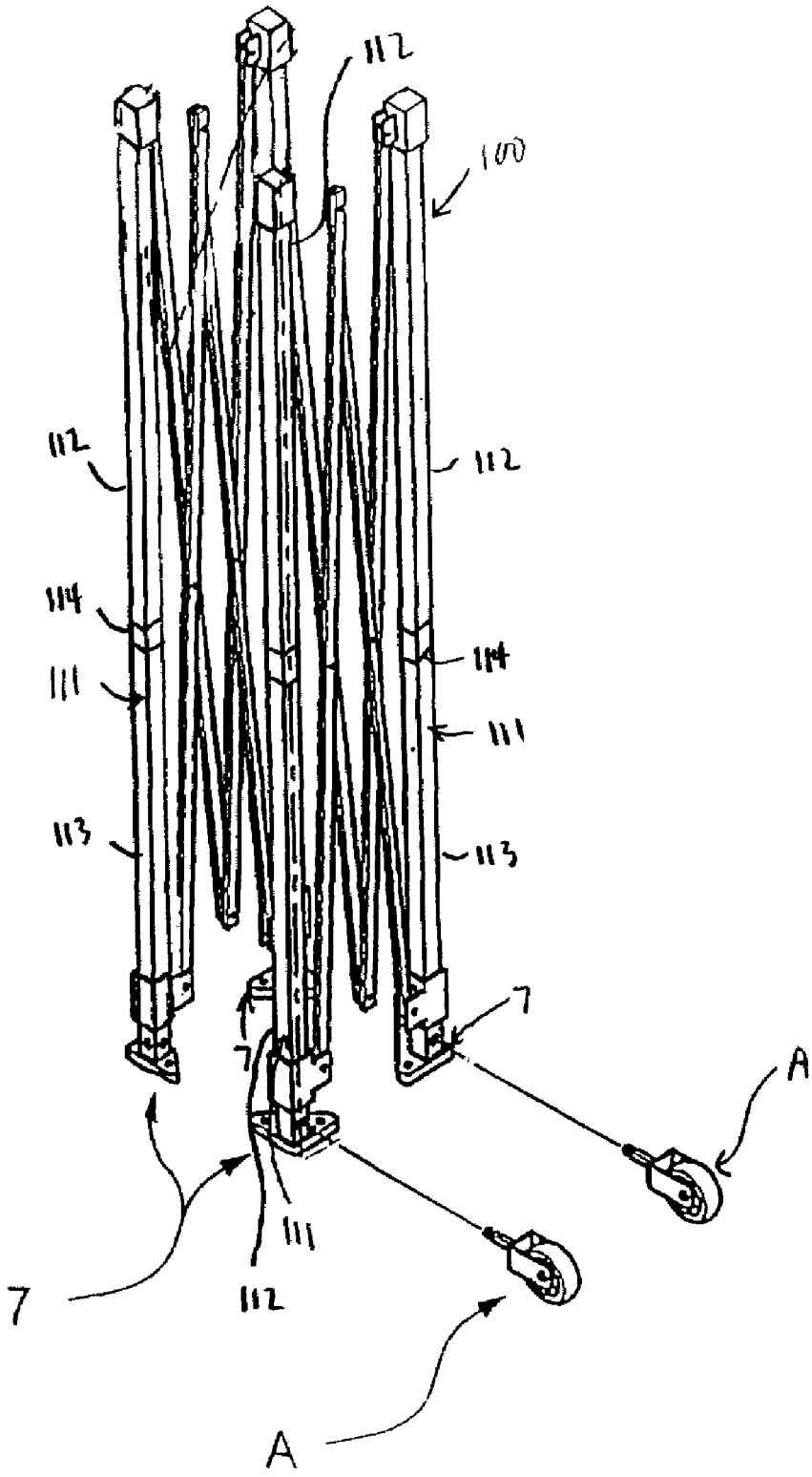
FIG. 14 is an exploded perspective view of wheel assemblies of FIG. 5 connectable to the collapsible canopy frame of FIG. 1, wherein the collapsible canopy frame is shown in a collapsed position.

FIGS. 1 and 4 illustrate the collapsible canopy frame 100 and the side pole 111, respectively, in a fully opened position, in which the ribs 202 and 203 are in a generally horizontal orientation. As the canopy is being collapsed, the angle between the scissor assemblies and the connecting members 210 and 38 decreases, and the distance between the adjacent side poles 111 decreases. Meanwhile, the sliding mounting bracket 115 slides along the upper section 112 in a downward direction towards the height adjustment bracket 114 and away from the stationary mounting bracket 40. FIG. 14 shows the collapsible canopy frame 100 in a collapsed position.

Figure 5:
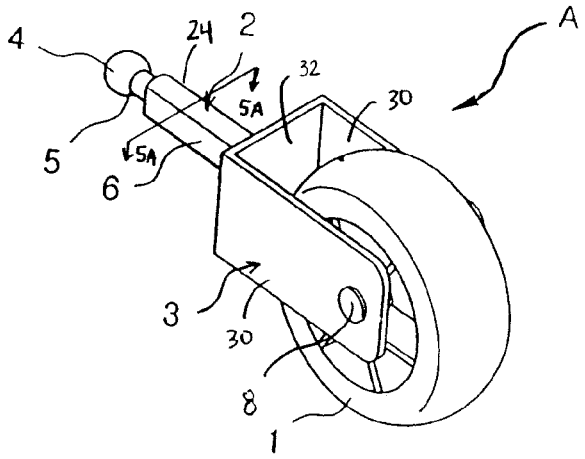
FIG. 5 is a perspective view of a wheel assembly according to an exemplary embodiment of the present invention.

FIG. 5 is an enlarged view of the wheel assembly A for attachment to the collapsible canopy frame 100. As shown, the wheel assembly A includes a bracket 3 having a wheel axle 8 mounted thereto. The wheel axle 8 rotatably supports a wheel 1. In the depicted embodiment, the bracket 3 is substantially U-shaped having opposing sides 30 disposed in surrounding relation to the wheel 1. A third side 32 of the bracket 3 connects the opposing sides 30 of the bracket 3. A post 2 is mounted to the third side 32 of the bracket 3. Although a U-shaped bracket 3 is described, in other embodiments, the bracket 3 may have configurations other than U-shaped.

Figure 5A:
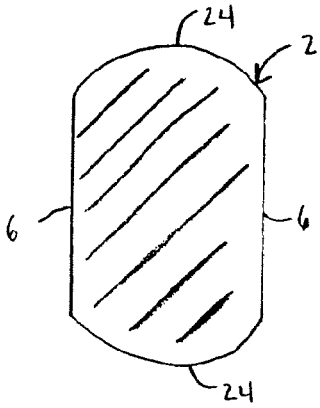
FIG. 5A is a cross-sectional view of a post of the wheel assembly taken along line 5A-5A of FIG. 6.
Figure 6:
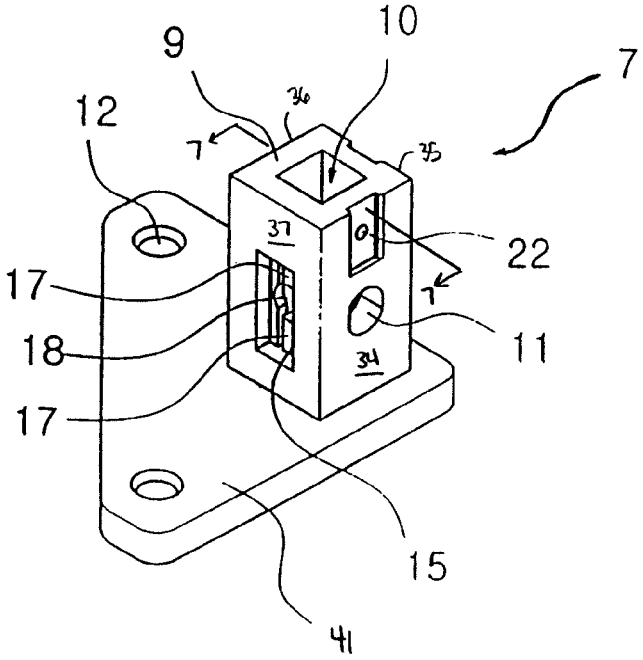
FIG. 6 is a perspective view of a foot bracket according to an exemplary embodiment of the present invention.
Figure 7:
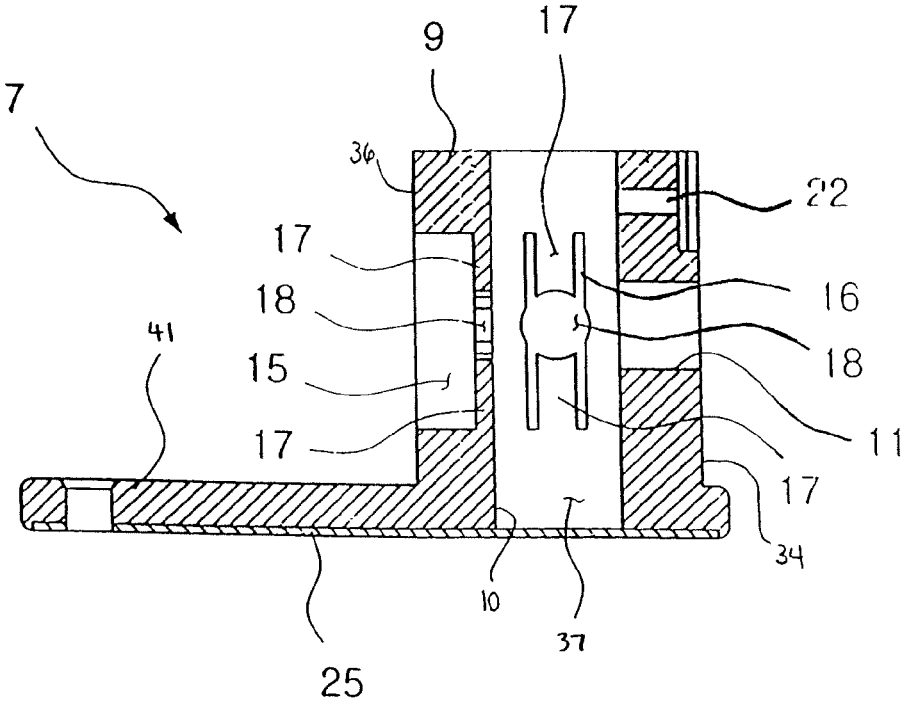
FIG. 7 is a cross-sectional view of the foot bracket of FIG. 6 taken along line 7-7 of FIG. 6.

In one embodiment, as shown in FIG. 5A, the post 2 has a substantially oval shaped outer surface, with two opposing flat sides 6 disposed between two opposing curved sides 24. Formed on an end of the post 2, opposite from the wheel 1, is a globe-shaped protrusion 4. The globe-shaped protrusion 4 is separated from a remainder of the post 2 by a recessed area 5, such as a cylindrical recess. The recessed area 5 is recessed from both the protrusion 4 and the remainder of the post 2.

Figure 8:
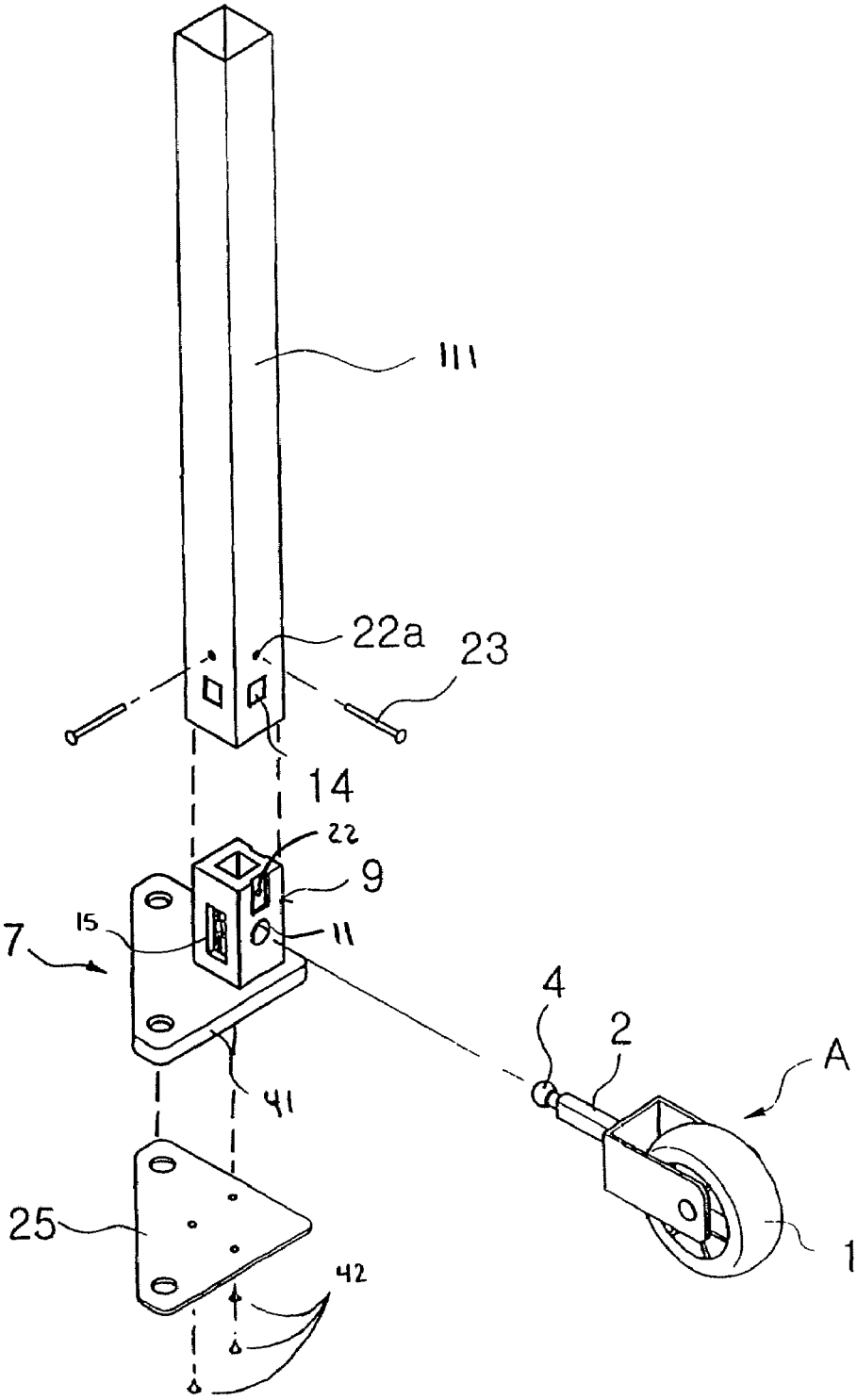
FIG. 8 is an exploded perspective view of the wheel assembly of FIG. 5; the foot bracket of FIG. 6; and the elongated side pole of the collapsible canopy frame of FIG. 1.
Figure 10:
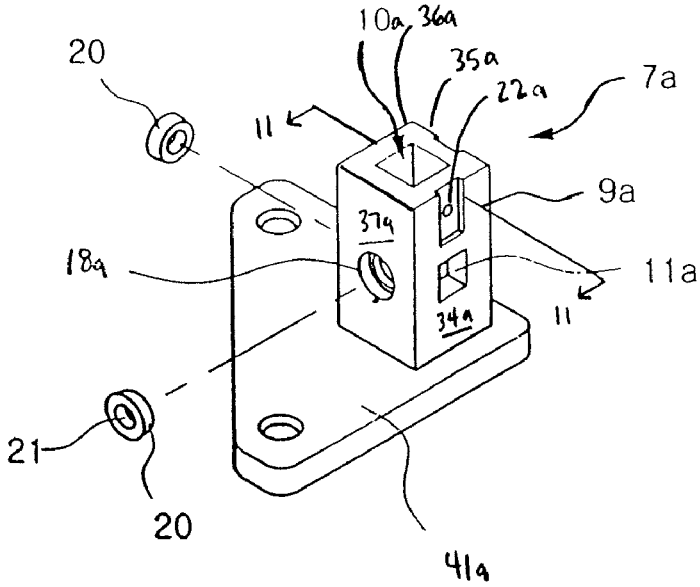
FIG. 10 is a perspective view of a foot bracket according to another exemplary embodiment of the present invention.
Figure 11:
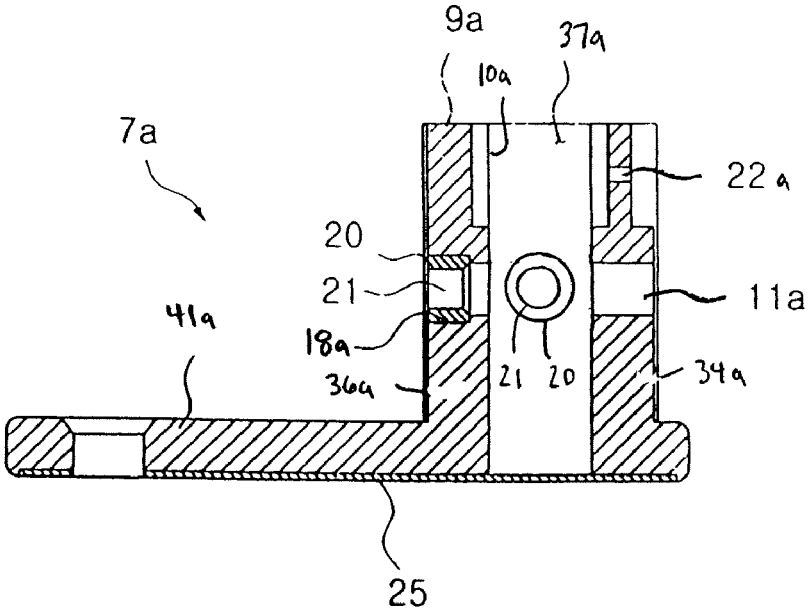
FIG. 11 is a cross-sectional view of the foot bracket of FIG. 10 taken along line 11-11 of FIG. 10.
Figure 12:
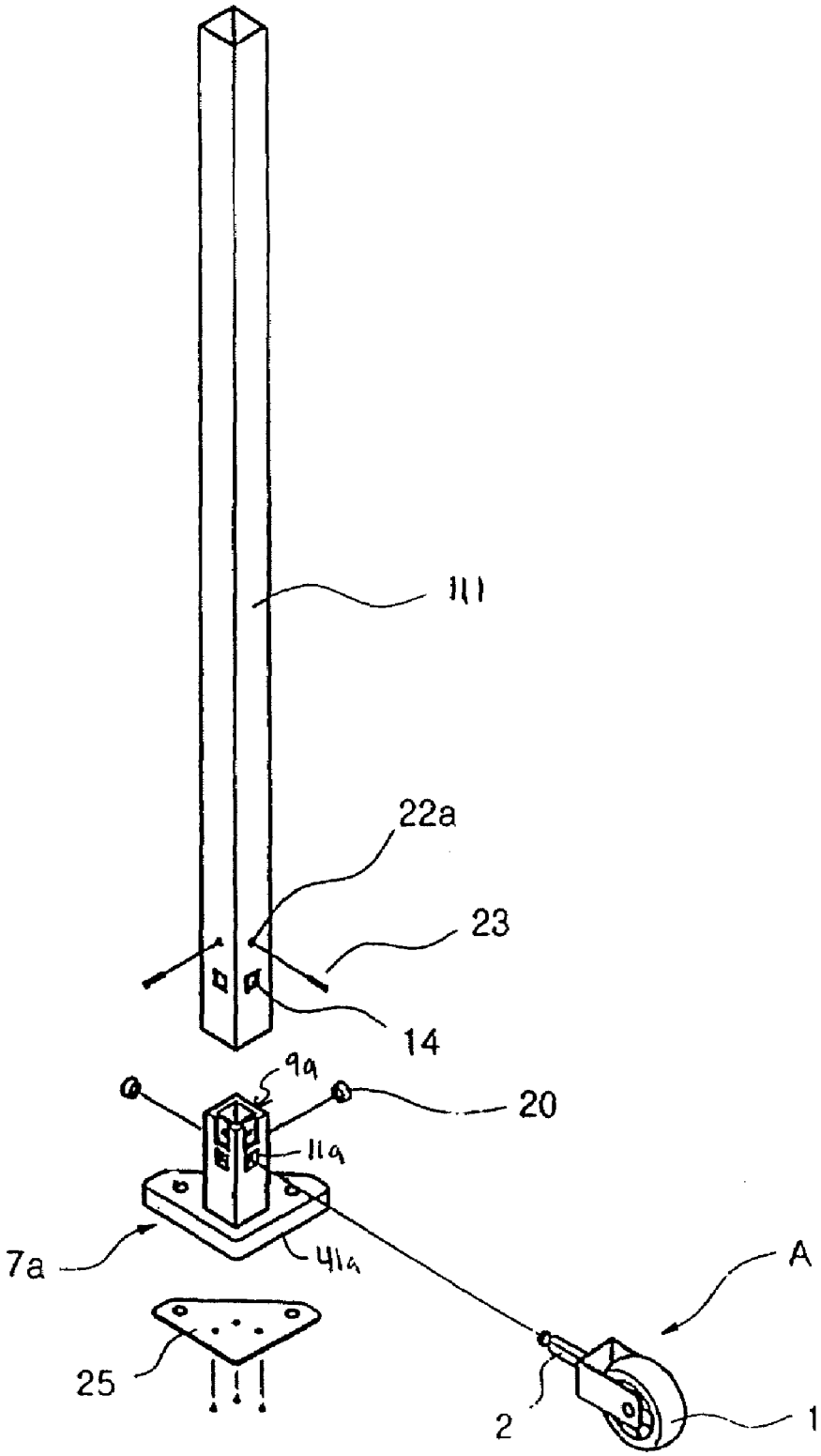
FIG. 12 is an exploded perspective view of the wheel assembly of FIG. 5; the foot bracket of FIG. 10; and the elongated side pole of the collapsible canopy frame of FIG. 1.

FIGS. 6-9 show an exemplary embodiment of the foot bracket 7. As shown in FIG. 8, the foot bracket 7 is attached to the side pole 111 of the collapsible canopy frame 100 and receives a wheel assembly A. Although only one side pole 111 is shown, in one embodiment each of the side poles 111 of the collapsible canopy frame 100 of FIG. 1 receives a corresponding foot bracket 7.

Viewing FIGS. 6-9 together, the foot bracket 7 includes the support plate 41. Extending from the support plate 41 is a fixing member 9 having a rectangular shaped outer surface. In the depicted embodiment, the side pole 111 is substantially hollow with rectangular-shaped inner and outer surfaces. The foot bracket 7 is inserted into the open bottom end of the side pole 111 for supporting a portion of the weight of the collapsible canopy frame 100.

In this embodiment, the rectangular inner surface of the side pole 111 is slightly larger than the rectangular outer surface of the fixing member 9, such that the side pole 111 snugly receives the fixing member 9. This arrangement helps prevent rotation of the foot bracket 7 relative to the side pole 111, and ensures a proper alignment of a fastener opening 22*a* in the side pole 111 with a fastener opening in the foot bracket 7 (discussed below) and also ensures a proper alignment of a post opening 14 in the side pole 111 with a first post opening 11 in the fixing member 9 (discussed below.)

To secure the foot bracket 7 to the side pole 111, the fixing member 9 is inserted into the bottom end of the side pole 111, until the bottom end of the side pole 111 rests against the support plate 41. In this position, the fastener opening 22*a* in a lower end of the side pole 111 is aligned with a corresponding fastener opening 22 in the fixing member 9 and the post opening 14 in the side pole 111 is aligned with the first post opening 11 in the fixing member 9. A fastener 23, such as a pin, is inserted into each of the fastener openings 22*a* and 22 of the side pole 111 and the foot bracket 7, respectively, to secure the foot bracket 7 to the side pole 111.

A protective plate 25, such as a metallic plate, having substantially the same shape and size as the support plate 41 is optionally attached at the bottom of the support plate 41 to protect the support plate 41 from wear and tear. In one embodiment, the protective plate 25 is removably secured to the support plate 41, such as by fasteners 42.

As shown in FIGS. 6-9, the fixing member 9 is rectangular shaped having four sides: a first side 34, a second side 35, a third side 36 and a fourth side 37. Adjacent to each side 34-37 of the fixing member 9 is a central opening 10. In one embodiment, the first side 34 and the second side 35 each include a first post opening 11 and the third side 36 and the fourth side 37 each include the second post opening 18 and resilient tongues 17 (discussed below.) As such, to avoid duplicity the below description focuses primarily on the first side 34 and the second side 36, but it is to be understood that the descriptions of the first side 34 apply equally to the second side 35 and descriptions of the third side 36 apply equally to the fourth side 37.

As shown, the first side 34 of the fixing member 9 contains the first post opening 11, which receives the post 2 of the wheel assembly A as described below. The third side 36 of the fixing member 9, opposite from the first side 34 of the fixing member 9, contains a second post opening 18 that is aligned with the first post opening 11. The second post opening 18 is primarily defined by a pair of spaced apart, oppositely directed, resilient tongues 17. The resilient tongues 17 are flexibly movable relative to the third side 36 of the fixing member 9 due to slots 16 in the third side 36 of the fixing member 9 on opposing sides of each resilient tongue 17.

When the foot bracket 7 is secured to the side pole 111 as described above, the first post opening 11 in the first side 34 of the fixing member 9 is aligned with a corresponding post opening 14 in the side pole 111. To secure the wheel assembly A to both the foot bracket 7 and the side pole 111, the post 2 of the wheel assembly A is inserted into the post opening 14 of a corresponding side pole 111, the first post opening 11 in the first side 34 of the fixing member 9, and the second post opening 18 in the third side 36 of the fixing member 9.

Figure 9:
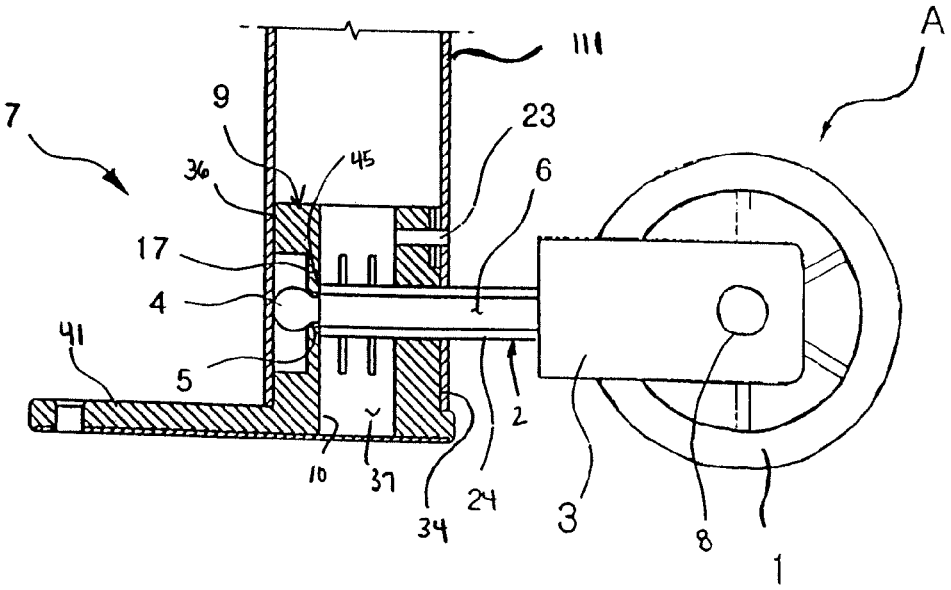
FIG. 9 shows the wheel assembly of FIG. 5 connected to the foot bracket of FIG. 6.

When the post 2 is inserted into the second post opening 18 in the third side 36 of the fixing member 9, the protrusion 4 at the end of the post 2, which is larger than the second post opening 18, forces the resilient tongues 17 outwardly and away from each other. When the protrusion 4 extends past the resilient tongues 17, as shown in FIG. 9, the resilient tongues 17 extend into recess 5, and the protrusion 4 extends into a notched section 15 of the third side 36 of the fixing member 9. The remainder of the post 2 is also larger than the second post opening 18, such that when the resilient tongues 17 extend into the recess 5, the resilient tongues 17 are disposed within the recess 5, therefore due to their resiliency secure the post 2 to the foot bracket 7 and hence the wheel assembly A to both the foot bracket 7 and the side pole 111 of the collapsible canopy frame 100. The post 2 also includes a shoulder 45 that is larger than and cannot extend into the second post opening 18 to ensure that the wheel 1 is spaced a distance from the side pole 111.

The wheel assembly A can be removed from the fixing member 9 and the side pole 111 by pulling the post 2 in a direction away from the fixing member 9, causing the protrusion 5 to force the resilient tongues 17 inwardly and away from each other, allowing the resilient tongues 17 to disengage from the recess 5 and the post to be removed from the fixing member 9 and the side pole 111. As such, in one embodiment, the wheel assembly A is removably attached to the fixing member 9.

As discussed above, in one embodiment, the post 2 has a substantially oval shaped outer surface, with two opposing flat sides 6 disposed between two opposing curved sides 24. In this embodiment, the first post opening 11 in the first side 34 of the fixing member 9 is formed as an oval shape of substantially the same size and shape of the outer surface of the post 2. As such, a rotational movement of the post 2 relative to the fixing member 9 is prevented, and hence a rotational movement of the wheel assembly A relative to each of the foot bracket 7 and the side pole 111 of the collapsible canopy frame 100 is prevented. However, in other embodiments the first post opening 11 and the outer surface of the post 2 may have any other appropriate shape and need not be of the same general shape and/or the same general size as long as a rotational movement of the of the post 2 relative to the fixing member 9 is prevented.

In one embodiment, the first post opening 11 in the first side 34 of the fixing member 9 is laterally offset by an angle of approximately 90 degrees with respect to a corresponding first post opening 11 in the second side 35 of the fixing member 9. As such, the wheel assembly A can be mounted to the fixing member 9 through the first and second post openings 11 and 18 of the first and third sides 34 and 36, respectively of the fixing member 9; or if it is desired to change the orientation of the wheel assembly A with respect to the side pole 111 of the collapsible canopy frame 100, the wheel assembly A can be mounted to the fixing member 9 through the first and second post openings 11 and 18 of the second and fourth sides 35 and 37, respectively, of the fixing member 9. In other embodiments, the outer surface of the fixing member 9 may have any appropriate shape. Also, in other embodiments, the first post opening in the first side 34 of the fixing member 9 may be laterally offset from the corresponding first post opening 11 in the second side 35 of the fixing member 9 by any appropriate angle.

In one embodiment, the fixing member 9 is formed form a plastic material. In one embodiment, the resilient tongues 17 are integrally molded with the fixing member 9. In another embodiment the resilient tongues 17 are formed separately form the fixing member 9.

In the embodiment of FIGS. 10-13, the foot bracket 7*a* contains some components that corresponding to some of the components described for the foot bracket 7 of FIGS. 6-9. As such, the components of the foot bracket 7*a* of FIGS. 10-13 that corresponding to components from the foot bracket 7 of FIGS. 6-9 are identified by the same reference numerals as the corresponding components from the foot bracket 7 of FIGS. 6-9 with the letter "a" added as a suffix.

The foot bracket 7*a* contains the support plate 41*a* having the fixing member 9*a* extending therefrom. The fixing member 9*a* includes first 34*a*, second 35*a*, third 36*a*, and fourth 37*a* sides. Adjacent to each side 34*a*-37*a* of the fixing member 9*a* is the central opening 10*a*. The first side 34*a* of the fixing member 9*a* contains the first post opening 11*a*, which is aligned with the second post opening 18*a* in the third side 36*a* of the fixing member 9*a*.

Mounted within the second post opening 18*a* is a ring shaped packing 20, or compression ring, having an opening 21 for receiving the post 2 of the wheel assembly A. The packing 20 is composed of a compressible and resilient material which returns to its original shape after compression, such as a rubber material. As such, to secure the wheel assembly A to both the foot bracket 7*a* and the side pole 111, the post 2 of the wheel assembly A is inserted into each of the post opening 14 of the side pole 111, the first post opening 11*a* in the first side 34*a* of the fixing member 9*a*, and the opening 21 in the packing 20. The opening 21 in the packing 20 is smaller than the protrusion 4 of the post 2. As such, when the protrusion 4 of the post 2 is inserted into the opening 21 in the packing 20, the packing 20 is compressed by and extends around the sides of the protrusion 4 of the post 2 to secure the post in the packing 20 and hence secure the wheel assembly A to both the foot bracket 7*a* and the side pole 111 of the collapsible canopy frame 100.

Figure 13:
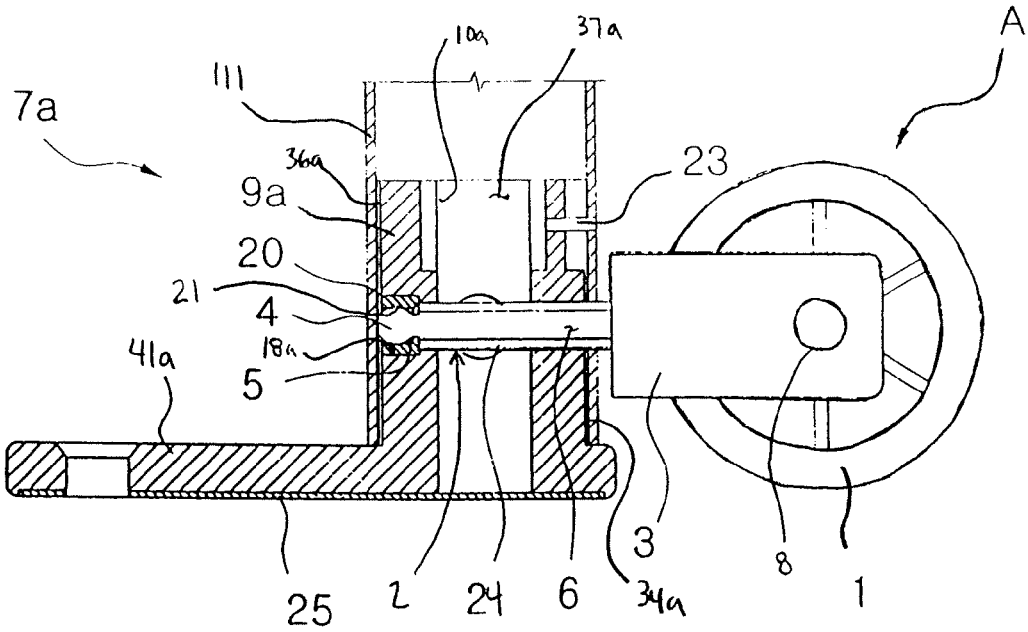
FIG. 13 shows the wheel assembly of FIG. 5 connected to the foot bracket of FIG. 10.

As shown in FIGS. 9 and 13, in one embodiment, when the wheel assembly A is attached to the foot bracket 7 or 7*a*, the wheel 1 is substantially horizontally aligned with a bottom surface of the foot bracket 7 or 7*a*. Also as shown in FIGS. 9 and 13, the mounting post 2 and wheel axle 8 extend perpendicularly to each other in a common plane. Also, the wheel assembly A is attached to a side surface of the side pole 111 of the collapsible canopy frame 100 rather than to a bottom surface of the side pole 111 of the collapsible canopy frame 100, features of which are discussed below.

To transport the collapsible canopy frame 100, the collapsible canopy frame 100 is adjusted to the collapsed position as shown in FIG. 14. Although FIG. 14 shows the collapsible canopy frame 100 as having a foot bracket 7 attached to each side pole 111, foot brackets 7*a* may alternatively be attached to each side pole 111. In the collapsed position, one or more wheel assemblies A, in the depicted embodiment two wheel assemblies A, may be attached to corresponding foot brackets 7.

In an upright position, the collapsed canopy is supported by the support plates 41 of the foot brackets 7. Hence, to transport the collapsible canopy frame 100 by use of the wheels 1 of the wheel assemblies A, the collapsible canopy frame 100 is tilted from the vertical, upright position so that the weight of the collapsible canopy frame 100 bears on the wheels 1 of the wheel assemblies A rather than the support plates 41 of the foot brackets 7. In such a titled position, the collapsible canopy frame 100 may be easily transported.

Therefore, in exemplary embodiments of the present invention, the wheel assemblies A are mounted along a side surface of the side poles 111 of the collapsible canopy frame 100 rather than on a bottom surface of the side poles 111 of the collapsible canopy frame 100. Otherwise, in order to mount a wheel assembly on a bottom surface of a side pole of a collapsible canopy frame, which is a relatively heavy structure, or placing the collapsible canopy frame on a wheeled structure, the collapsible canopy frame needs to be lifted off the ground in order to position the wheel assembly/wheeled structure beneath the collapsible canopy frame. Then after the collapsible canopy frame is transported to a desired location for use in the expanded position, the wheel assembly/wheeled structure needs to be removed to prevent the collapsible canopy frame from moving or rolling on the wheels. Thus, after set in the desired location and/or adjusted to the expanded position the collapsible canopy frame again needs to be lifted to remove the wheel assembly/wheeled structure. These problems are alleviated when the wheel assembly A is mounted to a side surface of the side pole 111.

Although the above description describes the wheel assembly A as being attached to the collapsible canopy frame 100 of FIGS. 1 and 14, the wheel assembly A may be attached to any other suitable collapsible canopy frame 100 having fixed-length or telescoping side poles. For example, a collapsible canopy frame having telescoping side poles is shown and described in U.S. patent application Ser. No. 10/728,154, entitled "Collapsible Canopy Frame and Locking Pin Assembly for the Same" filed on Dec. 4, 2003, issued as U.S. Pat. No. 7,395,830, which is herein incorporated by reference.

It will be appreciated by those of ordinary skill in the art that the invention can be embodied in other specific forms without departing from the spirit or essential character thereof. The present invention is therefore considered in all respects to be illustrative and not restrictive. The scope of the invention is indicated by the appended claims, and all changes that come within the meaning and range of equivalents thereof are intended to be embraced therein.

I claim:

1. A collapsible canopy frame comprising:

elongated side poles each having a side and an end; and a plurality of wheel assemblies each having a mounting post and a wheel and a wheel bracket and a wheel axle, the mounting post of each wheel assembly being attached to and extending from the wheel bracket and inserted into the side pole, being perpendicular to the wheel axle, and being supported on and extending transverse to a corresponding one of the elongated side poles to mount the wheel assembly to the side pole, and wherein the mounting post and the wheel axle extend in a common plane.

2. The collapsible canopy frame of claim 1, wherein each said wheel assembly is removably supported on the corresponding one of the elongated side poles.

3. The collapsible canopy frame of claim 1, wherein the mounting post of each said wheel assembly extends through the side of the corresponding one of the elongated side poles to which it is transverse.

4. The collapsible canopy frame of claim 3, further comprising a bracket in the interior of each corresponding one of the elongated side poles, wherein each said bracket and each said corresponding elongated side pole comprises an opening aligned with each other through which the mounting post of the corresponding wheel assembly extends.

5. The collapsible canopy frame of claim 4, wherein each said mounting post is removably secured in the corresponding bracket.

6. The collapsible canopy frame of claim 4, wherein the opening of each said bracket comprises a resilient compression material mounted therein, and wherein the resilient compression material has an opening that is smaller than an enlarged portion of the mounting post of the corresponding wheel assembly, such that the resilient compression material compressibly secures the enlarged portion of the mounting post in the bracket to secure the mounting post to the bracket.

7. The collapsible canopy frame of claim 1, wherein the side of each elongated side pole is a vertical side.

8. The collapsible canopy frame of claim 1, wherein the mounting post extends perpendicularly to the side of the corresponding one of the elongated side poles.

9. The collapsible canopy frame of claim 1, wherein the mounting post comprises an enlarged portion and a recessed portion, the enlarged portion being inserted into the side pole.

10. The collapsible canopy frame of claim 1, wherein the side pole has a square cross-section.

11. The collapsible canopy frame of claim 1, further comprising a plurality of foot brackets, wherein each said foot bracket is mounted at the end of a corresponding one of the elongated side poles.

12. The collapsible canopy frame of claim 11, wherein each foot bracket comprises a support plate.

13. The collapsible canopy frame of claim 11, wherein the mounting post of each said wheel assembly is removably mounted to a corresponding one of the plurality of foot brackets.

14. The collapsible canopy frame of claim 11, wherein each said foot bracket comprises a first side surface having a first post opening that extends therethrough and receives the mounting post of a corresponding one of the plurality of wheel assemblies.

15. The collapsible canopy frame of claim 14, wherein the first side surface of each said foot bracket comprises at least one resilient tongue that defines at least a portion of the first post opening and engages a recess in the mounting post of the corresponding one of the plurality of wheel assemblies to secure the corresponding one of the plurality of wheel assemblies thereto.

16. The collapsible canopy frame of claim 14, wherein each said foot bracket comprises a second side surface having a second post opening, laterally offset from the first post opening, that extends therethrough to receive the mounting post of the corresponding one of the plurality of wheel assemblies.

17. The collapsible canopy frame of claim 14, wherein each said foot bracket comprises a compression material mounted in the first post opening, wherein the compression material has an opening that is smaller than an enlarged portion of the mounting post of a corresponding one of the plurality of wheel assemblies, such that the compression material compressibly receives the enlarged portion of the mounting post of the corresponding one of the plurality of wheel assemblies to secure it thereto.

18. The collapsible canopy frame of claim 1, wherein the mounting post is fixedly attached to the wheel bracket.

19. The collapsible canopy frame of claim 1, wherein the mounting post comprises a shoulder that spaces the wheel from the side pole.

20. A collapsible canopy frame comprising:

elongated side poles each having a side and an end;

a plurality of wheel assemblies each having a mounting post and a wheel and a wheel bracket and a wheel axle, the mounting post of each said wheel assembly being attached to and extending from the wheel bracket, being perpendicular to the wheel axle, and being supported on and extending transverse to a corresponding one of the elongated side poles to mount the wheel assembly to the side pole, wherein the mounting post of each said wheel assembly extends through the side of the corresponding elongated side pole, and wherein the mounting post and the wheel axle extend in a common plane; and a bracket mounted at the end of a corresponding one of each of the elongated side poles, wherein each said bracket and each corresponding elongated side pole comprises an opening aligned with each other through which the mounting post of the corresponding wheel assembly extends.

21. The collapsible canopy frame of claim 20, wherein each said wheel assembly is removably supported on the corresponding elongated side pole.

22. The collapsible canopy frame of claim 20, wherein a portion of each said bracket is disposed in the interior of the corresponding elongated side pole.

23. The collapsible canopy frame of claim 22, wherein each said mounting post is removably secured to the corresponding bracket.

24. The collapsible canopy frame of claim 20, wherein the opening of each said bracket comprises a resilient compression material mounted therein, and wherein the resilient compression material has an opening that is smaller than an enlarged portion of the mounting post of the corresponding wheel assembly, such that the resilient compression material compressibly secures the enlarged portion of the mounting post in the bracket to secure the mounting post to the bracket.

25. The collapsible canopy frame of claim 20, wherein the mounting post of each said wheel assembly is non-rotatably mounted to the corresponding bracket.

26. The collapsible canopy frame of claim 20, wherein a bottom of the wheel is aligned with a bottom surface of the bracket.

27. A collapsible canopy frame comprising:

telescoping elongated side poles each having an upper section and a lower section, wherein each said lower section comprises a side and an end;

a set of edge scissor assemblies pivotably coupled between adjacent ones of the telescoping elongated side poles, the set of edge scissor assemblies having ribs that rotate relative to each other; and a plurality of wheel assemblies each having a mounting post, a wheel, a wheel bracket, and a wheel axle, the mounting post extending out from the wheel bracket and extending in a common plane with the wheel axle, and the mounting post of each said wheel assembly being inserted into and extending transverse to the side of a corresponding one of the telescoping elongated side poles.

28. The collapsible canopy frame of claim 27, wherein the mounting post is perpendicular to the wheel axle.

29. The collapsible canopy frame of claim 27, further comprising a foot bracket mounted at an end of one of the side poles, with a hole in the foot bracket aligning with a hole in the side pole, and wherein the mounting post is removably inserted through the aligned holes in the side pole and the foot bracket to mount the wheel to the side pole.

* * * * *